US007516504B2

(12) United States Patent
Guez

(10) Patent No.: US 7,516,504 B2
(45) **Date of Patent: *Apr. 14, 2009**

(54) OSTEOPATHIC PILLOW

(76) Inventor: Gerard Guez, 2 Avenue de Messlne, 75008, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/002,004

(22) Filed: Dec. 14, 2007

(65) Prior Publication Data

US 2008/0092296 A1 Apr. 24, 2008

Related U.S. Application Data

(62) Division of application No. 10/572,432, filed on May 24, 2006, now Pat. No. 7,316,041.

(30) Foreign Application Priority Data

Sep. 16, 2003 (FR) ..... PCT/FR03/002735

(51) Int. Cl.
*A47G 9/00* (2006.01)

(52) U.S. Cl. ..... 5/636

(58) Field of Classification Search ..... 5/636, 5/638, 644, 637, 630; D6/601
See application file for complete search history.

(56) References Cited

U.S. PATENT DOCUMENTS 2,835,905 A 5/1958 Tomasson
3,124,812 A 3/1964 Milton et al.
3,482,571 A 12/1969 Behrendt
3,757,365 A 9/1973 Kretchmer
4,218,792 A 8/1980 Kogan
4,259,757 A 4/1981 Watson
D388,648 S 1/1998 Bates
D388,650 S 1/1998 Davis
5,848,448 A 12/1998 Boyd
D444,980 S 7/2001 Mowat et al.
6,381,784 B1 5/2002 Davis et al.
6,622,325 B1 9/2003 Garza

FOREIGN PATENT DOCUMENTS

EP 0 778 017 6/1997
WO WO 01/82756 11/2001

*Primary Examiner*—Alexander Grosz
(74) *Attorney, Agent, or Firm*—Robert L. Epstein; Epstein Drangel Bazerman & James, LLP

(57) ABSTRACT

The pillow (10) comprises a body (12) made of an elastically deformable material provided with a top side (14) upon which the head of a user can be rested, and an underside (16) for being placed upon a pillow support. The top side (14) is joined to the underside (16) by at least one shoulder side (18, 18*b*). Said shoulder side is provided with a shoulder cut-out (20A, 20B) that forms an opening for the cervical vertebrae of the user when he is lying on his back, and forms an accommodating space for the shoulder of the user when he is lying on his side. The top side (14) preferably comprises a recess (22) that partially accommodates the head of the user (H), called the head receiving recess (22).

8 Claims, 2 Drawing Sheets

OSTEOPATHIC PILLOW

The present application is a divisional application of U.S. application Ser. No. 10/572,432, filed May 24, 2006 now U.S. Pat. No. 7,316,041.

The present invention relates to an osteopathic pillow.

There already exists in the prior art a pillow of the type comprising a body of elastically deformable material provided with a top side upon which the head of a user can be rested, and an underside designed to be placed upon a pillow support, the top side being connected to the underside by at least one scapular side.

Generally speaking, the shape of an anatomical pillow is adapted to support the user's cervical vertebrae. Indeed, it being commonly thought that the cervical vertebrae require support during periods of rest lying.

Usually, however, at the end of the day, the cervical lordosis of a person is accentuated by the tension in the neck leading to retraction of the neck muscles. It would therefore seem more appropriate to relieve the cervical vertebrae by not supporting them during periods of rest lying.

It is an object of the invention to provide a pillow of the above type that will enable a gentle and progressive stretching of the cervical vertebrae in order to relax this vertebral segment during periods of rest lying.

To this end, the subject of the invention is a pillow of the above type, characterized in that the scapular side is provided with a scapular cut-out that forms both an indentation for the cervical vertebrae of the user when he is lying on his back, and an accommodating space for the shoulder of the user when he is lying on his side.

In accordance with other features of this pillow:

- the top side includes a recess, called the head receiving recess, that partially accommodates the head of the user;
- the top side includes a cervical connecting gutter forming a cervical indentation extending between the head receiving recess and the scapular cut-out so as to prevent, or at least limit, contact between the neck of the user and the top side of the body;
- the body of deformable material includes an orifice, called the ear orifice, opening at one end into the head receiving recess and at the other into the underside, this ear orifice making it possible to prevent or at least limit the compression of the ear of the user in contact with the pillow when the user is lying on his side;
- the top side is connected to the underside by two opposite scapular sides, each able to be in contact with the shoulder of the user as the user wishes, these two opposite shoulder sides each being provided with a scapular cut-out;
- the top side includes two cervical connecting gutters, each extending between the head positioning recess and a corresponding scapular cut-out;
- the top side and the underside are similar in shape and each can be used for the other;
- the body is made of a composite material in such a way that that part of the body which forms the top side is relatively dense, and therefore suitable for the winter, and that part of the body which forms the underside is relatively aerated, and therefore suitable for the summer;
- the overall shape of the body of deformable material is that of a prism;
- the overall prism shape of the mass of deformable material has at its base an isosceles trapezoid, each of the two parallel sides of this trapezoid forming a scapular side, and the other two sides of the trapezoid forming the top side and underside of the body;
- the body of deformable material is made of foam.

A clearer understanding of the invention will be gained from reading the following description, which is given purely by way of example, with reference to the drawings, in which.

Figure 1:
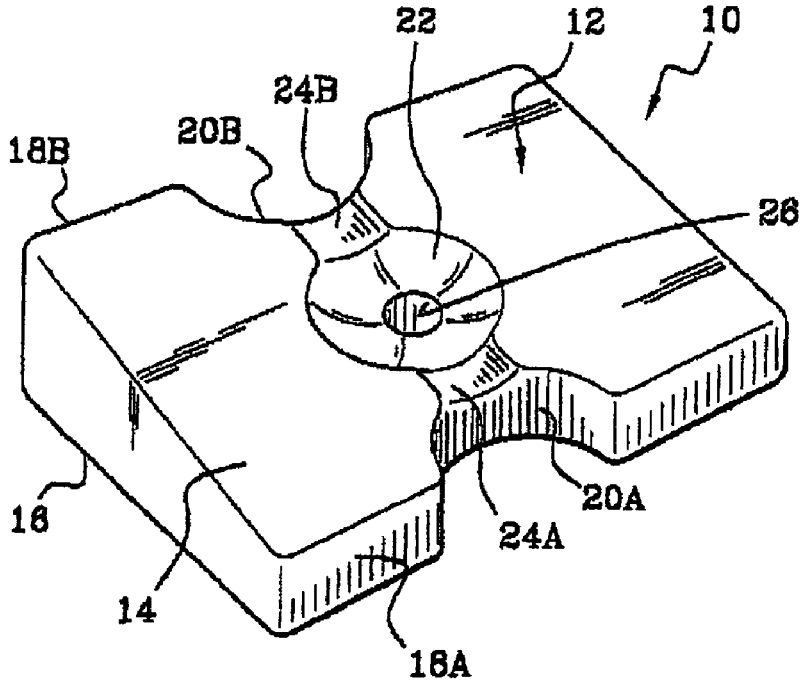
FIG. 1 is a perspective view of a pillow according to the invention.

The figures show a so-called osteopathic pillow according to the invention denoted by the general reference 10.

The pillow 10 comprises a body 12 made of an elastically deformable material, preferably synthetic or natural foam, the material also being mite-resistant.

The body 12 of deformable material can optionally be covered with a pillowslip (not shown in the figures).

In the example illustrated, the overall shape of the body 12 of deformable material is that of a prism. More particularly, the body 12 has at its base an isosceles trapezoid T, the outline of which is shown in FIG. 2.

The body 12 of deformable material is provided with a top side 14 on which the head of a user H can be rested. The body 12 of deformable material is also provided with an underside 16 designed to be placed upon a pillow 10 support, which will usually be an item of bedding such as a mattress.

The top side 14 is connected to the underside 16 by a first scapular side 18A designed to come into contact with the shoulder or shoulders of the user H.

Figure 2:
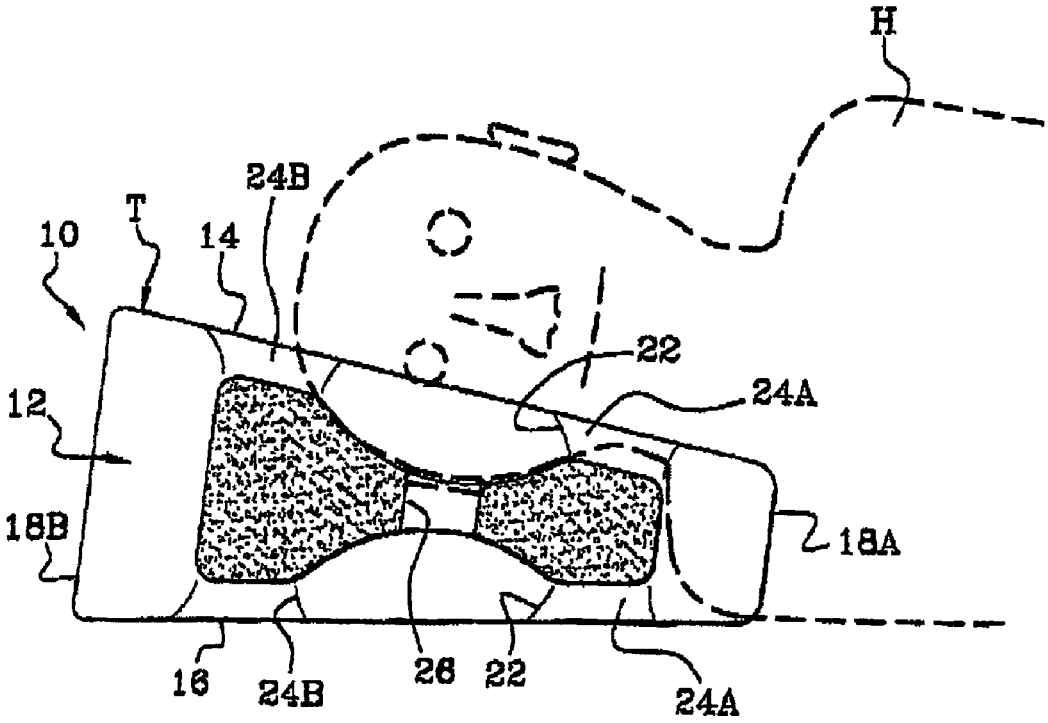
FIG. 2 is a side view, with a longitudinal section, of the pillow illustrated in FIG. 1, showing a user lying on his side with his head resting on the pillow.
Figure 3:
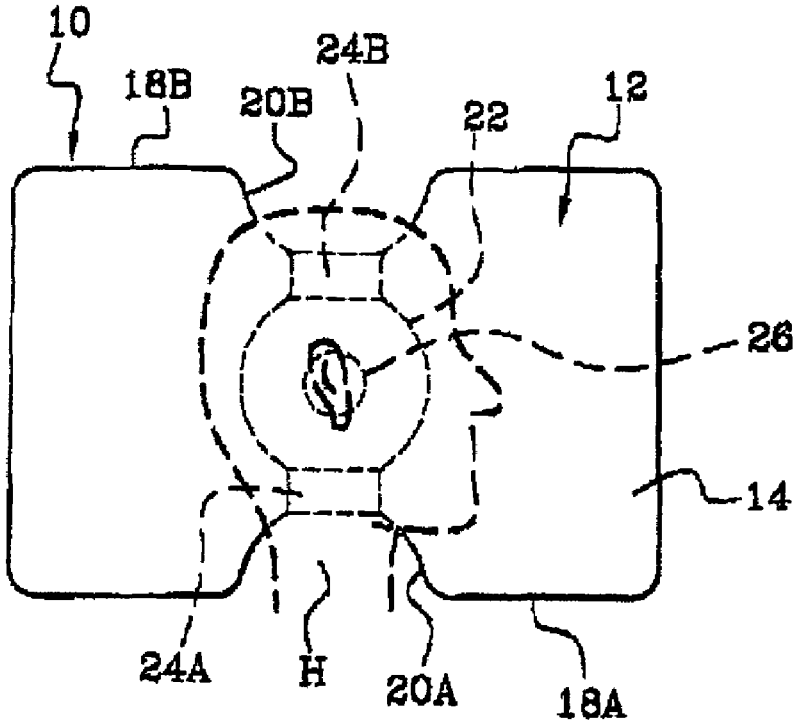
FIGS. 3 and 4 are top views of the pillow illustrated in the previous figures, showing a user lying on his side and back, respectively.
Figure 4:
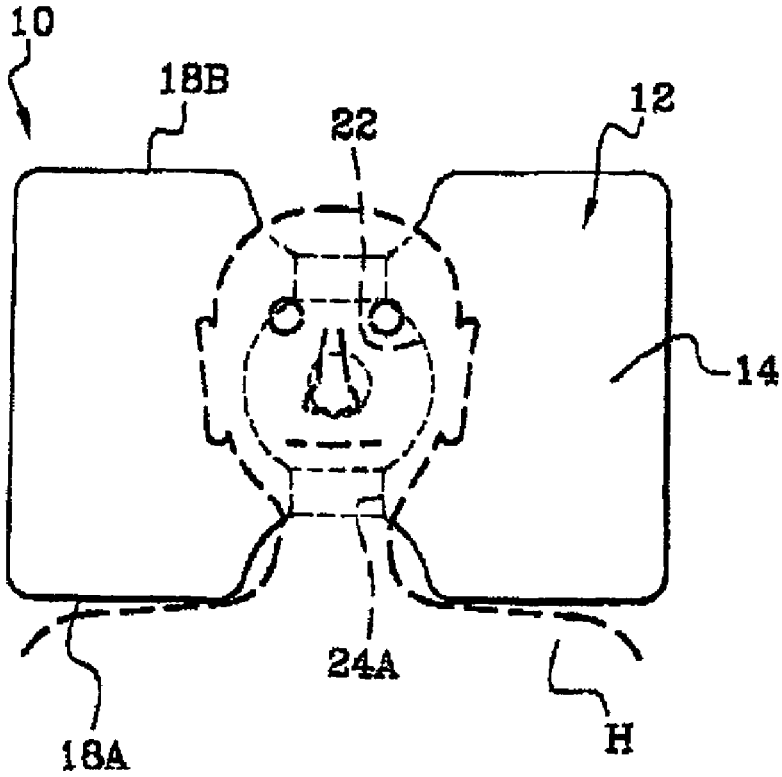

The first scapular side 18A is provided with a first scapular cut-out 20A forming an accommodating space for the shoulder of the user H when this user is lying on his side, as shown in FIGS. 2 and 3. This first cut-out 20A also forms an indentation for the cervical vertebrae of the user H when this user is lying on his back, as shown in FIG. 4.

In addition, the top side 14 includes a recess 22, called the head receiving recess 22, that partially accommodates the head of the user H.

The first shoulder cut-out 20A is connected to the head receiving recess 22 by a first connecting cervical gutter 24A. This gutter 24A forms a cervical indentation designed to prevent or at least limit contact between the neck of the user H and the top side 14 of the body 12.

The body 12 of deformable material includes an orifice 26, called the ear orifice 26, opening at one end into the head receiving recess 22 and at the other into the underside 16 of the body 12. The function of the ear orifice 26 is to prevent or at least limit the compression of the ear of the user H in contact with the pillow 10 when this user H is lying on his side as shown in FIGS. 2 and 3.

The top side 14 is connected to the underside 16 by a second scapular side 18B opposite the first scapular side 18A.

It will be seen that the two parallel sides of the trapezoid T define the two scapular sides 18A, 18B. The other two sides of the trapezoid T form the top side 14 and the underside 16 of the body 12 of deformable material.

The second scapular side 18B is, like the first scapular side 18A, provided with a second scapular cut-out 20B having the same function as the first cut-out 20A.

The top side 14 of the body 12 of deformable material is also provided with a second cervical gutter 24B extending between the head receiving recess 22 and the second scapular cut-out 20B.

As a matter of preference, the top side 14 and the underside 16 of the body 12 are similar in shape and each can be used for the other.

Thus, the underside 16 comprises, like the top side 14, a head receiving recess 22, in which lies the open end of the ear orifice 26, and two cervical gutters 24A, 24B.

If desired, the material of the body 12 may be composite in such a way that that part of the body 12 which forms, for example, the top side 14 is relatively dense, and therefore suitable for the winter, and that part of the body 12 which forms the underside 16 is relatively aerated, and therefore suitable for the summer.

The main invention-related use aspects of the pillow 10 will be detailed below.

When the user H is lying on his side, as shown in FIGS. 2 and 3, he places his head in a recess 22 such as that formed on the top side 14 of the pillow.

The ear of the user H which is in contact with the pillow sits at least partly within the ear orifice 26. This limits the compression on this ear. It will be seen that when the user H is lying down, the shoulder that is in contact with the pillow 10 has a tendency to close up towards the user's head. The scapular cut-out 20A accommodates this shoulder close to the head.

The connecting gutter 24A forms an indentation for the cervical vertebrae of the user H so that this vertebral segment is hardly resting on the pillow 10. This allows a gentle, progressive stretching of the cervical vertebrae.

It will be seen that the top side 14 and the underside 16 converge from the second scapular side 18B towards the first scapular side 18A, which is lower than the second scapular side 18B. This allows the pillow 10 to be adapted to different user H morphologies. A child will find it better to place the first scapular side 18A (the lower side) in contact with his shoulder, while an adult will find it better to place the second scapular side 18B (the higher side) in contact with his shoulder.

When the user H is lying on his back, he places his head in a head positioning recess 22, such as that formed in the top side 14 of the body 12, as shown in FIG. 4.

Assuming the first scapular side 18A to be in contact with the shoulders of the user H, the cut-out 20A and the cervical gutter 24A form indentations that prevent or at least limit contact between the cervical vertebrae and the pillow 10. The cervical vertebrae can thus stretch gently and progressively in order to relax this vertebral segment while the user is lying down.

It will be seen that the ear orifice 26 optimizes the aeration of the pillow 10 in such a way as to limit any sweating of the user H and/or assist in carrying away this sweat.

The invention claimed is:

1. A pillow of the type comprising a body (12) of elastically deformable material provided with a top side (14) upon which the head of a user (H) can be rested, and an underside (16) designed to be placed upon a pillow support, the top side (14) being connected to the underside (16) by at least one scapular side (18A, 18B), wherein the top side includes a recess, called the head receiving recess, that partially accommodates the head of the user, the scapular side (18A, 18B) being provided with a scapular cut-out (20A, 20B) that forms both an indentation for the cervical vertebrae of the user (H) when he is lying on his back, and an accommodating space for the shoulder of the user (H) when he is lying on his side, the top side (14) includes a cervical gutter forming a cervical indentation extending between the head receiving recess (22) and the scapular cut-out (20A, 20B) so as to prevent or at least limit contact between the neck of the user (H) and the top side (14) of the body (12), the body (12) of deformable material includes an orifice (26), called the ear orifice (26), opening at one end into the head receiving recess (22) and at the other into the underside (16), this ear orifice (26) making it possible to prevent or at least limit the compression of the ear of the user (H) in contact with the pillow when the user (H) is lying on his side.

2. The pillow as claimed in claim 1, wherein the top side (14) is connected to the underside (16) by two opposite scapular sides (18A, 18B), each able to be in contact with the shoulder of the user (H) as the user wishes, these two opposite shoulder sides 10 (18A, 18B) each being provided with a scapular cut-out (20A, 20B).

3. The pillow as claimed in claim 2, wherein the top side (14) includes two cervical connecting gutters (24A, 24B), each extending between the head positioning recess (22) and a corresponding scapular cut-out (20A, 20B).

4. The pillow as claimed in claim 1, wherein the top side (14) and the underside {16) are similar in shape and each can be used for the other.

5. The pillow as claimed in claim 4, wherein the body (12) is made of a composite material in such a way that that part of the body (12) which forms the top side (14) is relatively dense, and therefore suitable for the winter, and that part of the body (12) which forms the underside (16) is relatively aerated, and therefore suitable for the summer.

6. The pillow as claimed in claim 1, wherein the overall shape of the body (12) of deformable material is that of a prism.

7. The pillow as claimed in claim 6, wherein the overall prism shape of the mass (12) of deformable material has at its base an isosceles trapezoid, each of the two parallel sides of this trapezoid forming a scapular side (18A, 18B), and the other two sides of the trapezoid forming the top side (14) and underside (16) of the body {12).

8. The pillow as claimed in claim 1, wherein the body (12) of deformable material is made of foam.

* * * * *